US007811212B2

(12) United States Patent
Chen

(10) Patent No.: US 7,811,212 B2
(45) **Date of Patent: *Oct. 12, 2010**

(54) ADJUSTABLE KETTLEBELL

(76) Inventor: Paul Chen, 7771 Goldstream Dr., Richmond, Vancouver, BC (CA) V7A 1S5

( * ) Notice: Subject to any disclaimer, the term of this patent is extended or adjusted under 35 U.S.C. 154(b) by 0 days.

This patent is subject to a terminal disclaimer.

(21) Appl. No.: 12/322,087

(22) Filed: Jan. 28, 2009

(65) Prior Publication Data

US 2010/0190619 A1 Jul. 29, 2010

(51) Int. Cl.
*A63B 21/072* (2006.01)
*A63B 21/075* (2006.01)

(52) U.S. Cl. ..... 482/107; 482/106

(58) Field of Classification Search ..... 482/44–45, 482/49–50, 106–108, 93; D21/680–682
See application file for complete search history.

(56) References Cited

U.S. PATENT DOCUMENTS 1,316,683 A * 9/1919 Calvert ..... 482/93
1,917,566 A * 7/1933 Wood ..... 482/108
4,431,185 A * 2/1984 Cisneros ..... 482/93
4,659,079 A * 4/1987 Blanchard ..... 473/60
7,052,445 B2 * 5/2006 Ekhaus ..... 482/93
D522,594 S * 6/2006 Donahue et al. ..... D21/682
7,182,715 B2 2/2007 Anderson ..... 482/93
7,381,157 B2 * 6/2008 Blateri ..... 482/50
7,563,208 B1 * 7/2009 Chen ..... 482/93
2008/0081744 A1 * 4/2008 Gormley ..... 482/93

FOREIGN PATENT DOCUMENTS

JP 2007021123 A * 2/2007

* cited by examiner

*Primary Examiner*—Fenn C Mathew
(74) *Attorney, Agent, or Firm*—Charles E. Baxley

(57) ABSTRACT

An adjustable kettlebell includes a shaft having a narrowed neck segment formed on one end portion and having a base plate attached to the other end portion, two or more weight members each having a slot for receiving the narrowed neck segment of the shaft, and each having an enlarged opening communicating with the slot for receiving the shaft and for retaining the weight members to the shaft when the weight members are offset from the narrowed neck segment of the shaft, and a sliding member is slidably attached onto the shaft for engaging with the weight members after the weight members have been disengaged from the narrowed neck segment of the shaft and for retaining the weight members to the shaft.

8 Claims, 4 Drawing Sheets

ADJUSTABLE KETTLEBELL

BACKGROUND OF THE INVENTION

1. Field of the Invention

The present invention relates to an adjustable kettlebell, and more particularly to an adjustable kettlebell including an improved structure for allowing the weight members to be easily and quicly and adjustably attached to or disengaged from the weight carrier and for allowing the adjustable kettlebell to be easily operated by the users.

2. Description of the Prior Art

Typical kettlebells comprise a pair of oppositely-facing, generally frustum-shaped weight plates attached to a central plate with a first axis that is perpendicular to the axis of its handle, and the frustum-shaped weight plates may reduce the force of impact against the user's forearm during certain exercise movements.

For example, U.S. Pat. No. 7,182,715 to Anderson discloses one of the typical kettlebells comprising a handle attached to a central plate and including places which can be held between the user's thumb and remaining fingers for improved control during other exercise movements.

However, the weight plates may not be easily adjusted and/or changeably attached to the central plate such that the weight of the typical kettlebell may not be changed or adjusted.

U.S. Patent Application Publication No. 2008/0081744 A1 to Gormley discloses another typical adjustable kettlebell comprising a series of plates in stacked relationship, a handle having a shaft passing through the weight plates and a retaining arrangement including a base engageable with the shaft for holding and securing the weight plates together between the handle and the retaining arrangement.

However, the base should be removed or disengaged from the shaft when engaging the weight plates onto the shaft or when disengaging the weight plates from the shaft, such that it takes time to attach or to disengage the weight plates from the shaft and such that the typical adjustable kettlebell may not be easily operated by the users.

The present invention has arisen to mitigate and/or obviate the afore-described disadvantages of the conventional adjustable kettlebells.

SUMMARY OF THE INVENTION

The primary objective of the present invention is to provide an adjustable kettlebell or exercise device including an improved structure for allowing the weight members to be easily and quickly and adjustably attached to or disengaged from the weight carrier and for allowing the adjustable kettlebell to be easily operated by the users.

In accordance with one aspect of the invention, there is provided an adjustable kettlebell comprising a shaft including a first end portion, and including a second end portion, and including a narrowed neck segment formed in the first end portion of the shaft, a base plate attached to the second end portion of the shaft and including an outer diameter greater than that of the shaft, a first weight member and at least one second weight member each including a slot formed therein and having a width no less than the narrowed neck segment of the shaft for receiving the narrowed neck segment of the shaft, and for allowing the first and the second weight members to be attached to and disengaged from the shaft, the first and the second weight members each including an enlarged opening formed therein and communicating with the slot of the first and the second weight member, and the enlarged opening including an inner diameter greater than the width of the slots of the first and the second weight members and no less than the outer diameter of the shaft for receiving the shaft, and for allowing the first and the second weight members to be retained to the shaft and for preventing the first and the second weight members from being disengaged from the shaft when the first and the second weight members are offset from the narrowed neck segment of the shaft, and a sliding member slidably attached onto the shaft for engaging with the weight members after the weight members have been engaged onto the shaft and after the weight members have been disengaged from the narrowed neck segment of the shaft, and the sliding member including a latch for engaging with the shaft and for selectively and quickly or easily locking or latching the sliding member to the shaft, in order to retain and secure the weight members to the shaft.

The shaft includes a rack provided on or extended from the shaft for selectively engaging with the latch. The sliding member includes a channel formed therein for slidably receiving the rack of the shaft.

The latch is pivotally attached to the sliding member with a pivot axle and includes an actuating end for engaging with the rack and for adjustably latching the sliding member and the weight members to the shaft.

The sliding member includes a spring member disposed between the latch and the sliding member for biasing and forcing the actuating end of the latch to engage with the rack and to latch or lock the sliding member to the shaft, in order to retain and secure the weight members to the shaft.

The shaft includes at least one notch formed in the shaft for forming or defining the narrowed neck segment in the shaft. The shaft includes a hand grip provided on the first end portion of the shaft.

The weight members each include an open end communicating with the slots of the weight members for guiding the narrowed neck segment of the shaft to be easily and quickly engaged into the slots of the weight members.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
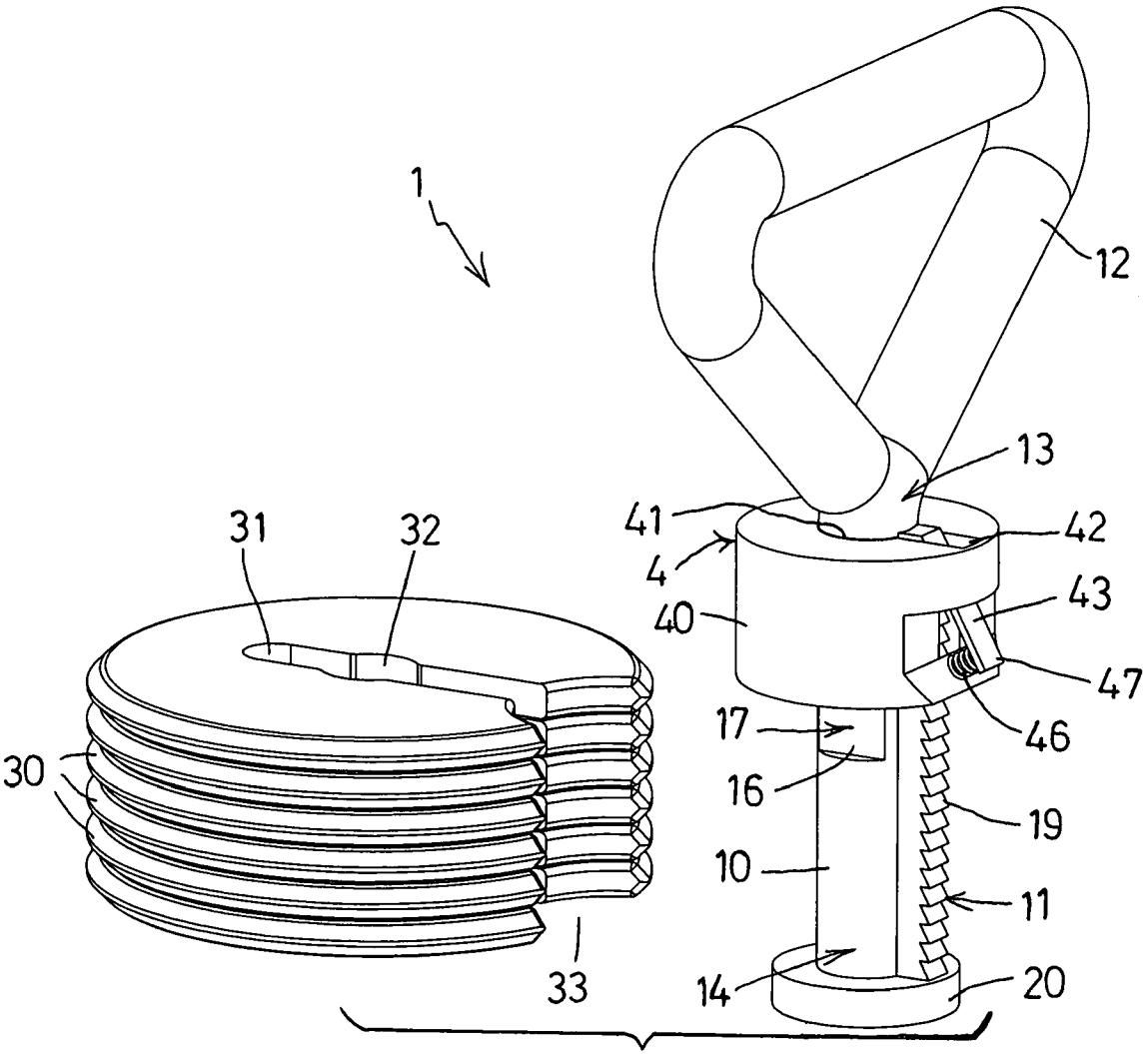
FIG. 1 is a partial exploded view of an adjustable kettlebell in accordance with the present invention.
Figure 2:
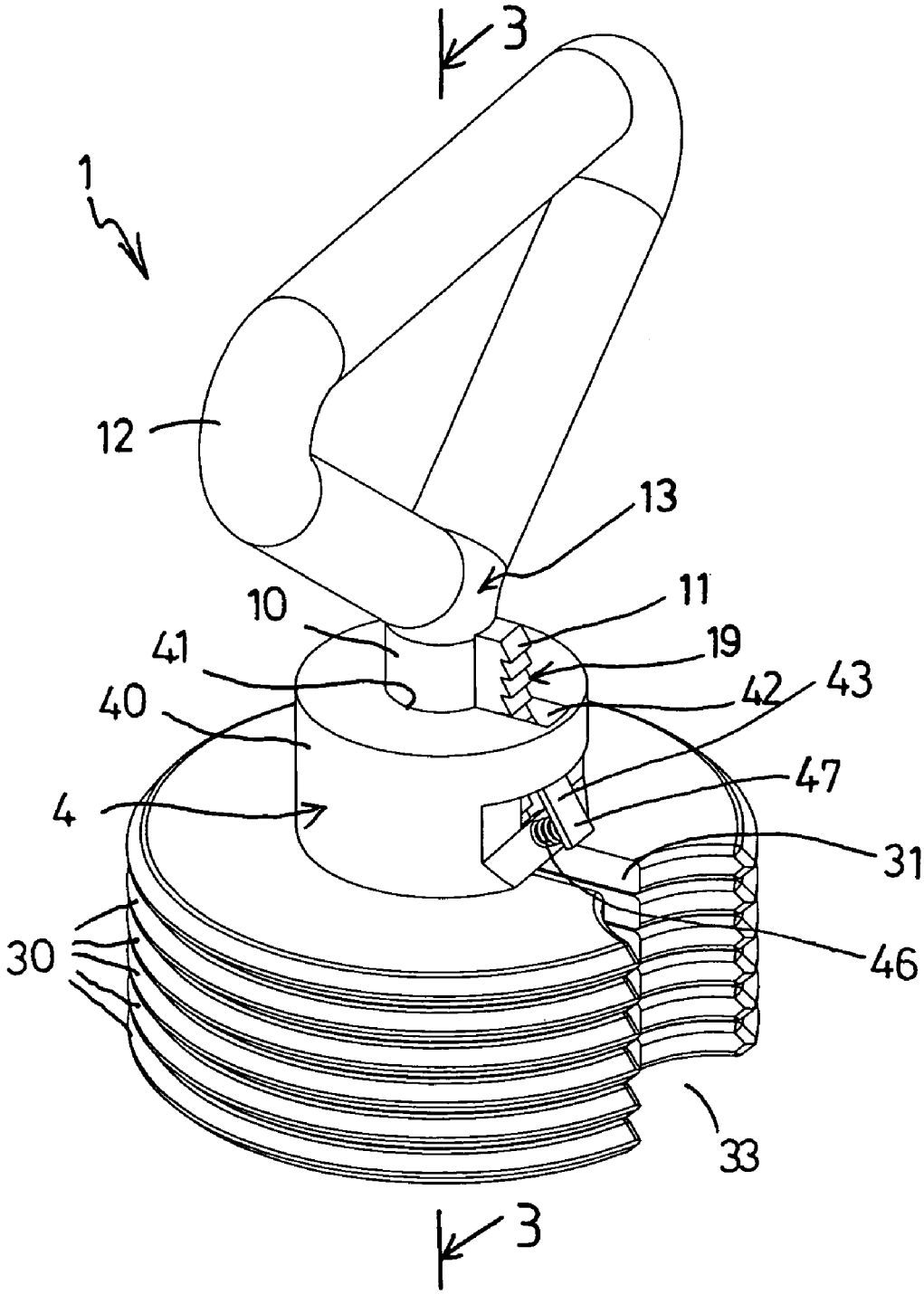
FIG. 2 is a perspective view of the adjustable kettlebell.

Referring to the drawings, and initially to FIGS. 1-4, an adjustable kettlebell 1 in accordance with the present invention comprises a longitudinal and/or vertical or central shaft 10 including a rack 11 formed or provided on the outer peripheral portion thereof, and including a handle 12 formed or provided on the upper portion or one end portion 13 of the shaft 10 for being grasped or held by the users and for carrying or lifting or moving the shaft 10 and for allowing the adjustable kettlebell 1 to be easily operated by the users. A carrier or base plate 20 is attached or secured to the lower or bottom portion or the other end portion 14 of the shaft 10 with one or more latches or fasteners 15, in which the base plate 20 includes an outer diameter greater than that of the shaft 10.

The base plate 20 may also be formed integral with the handle 10 with molding or mold-injection processes or with forging processes. The rack 11 is preferably extended out of the shaft 10 and arranged parallel to the shaft 10, and includes a width smaller than the outer diameter of the shaft 10. The shaft 10 includes one or more (such as two) cut-off portions or notches 16 oppositely formed in the upper portion or one end portion 13 of the shaft 10 for forming a narrowed neck segment 17 in the upper portion or one end portion 13 of the shaft 10, in which a portion of the narrowed neck segment 17 of the shaft 10 includes an outer diameter smaller than that of the shaft 10.

Figure 3:
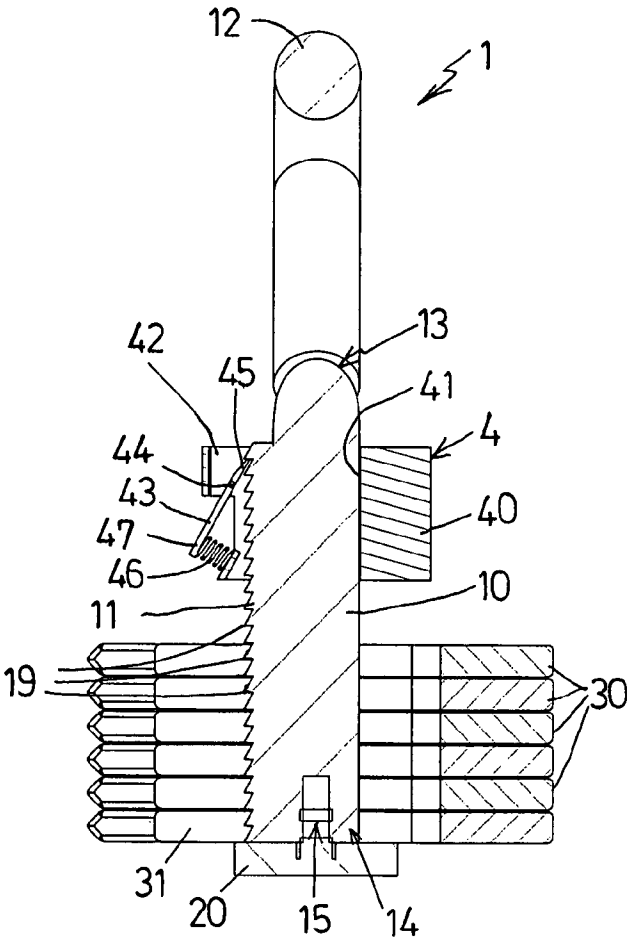
FIG. 3 is a cross sectional view of the adjustable kettlebell taken along lines 3-3 of FIG. 2.
Figure 5:
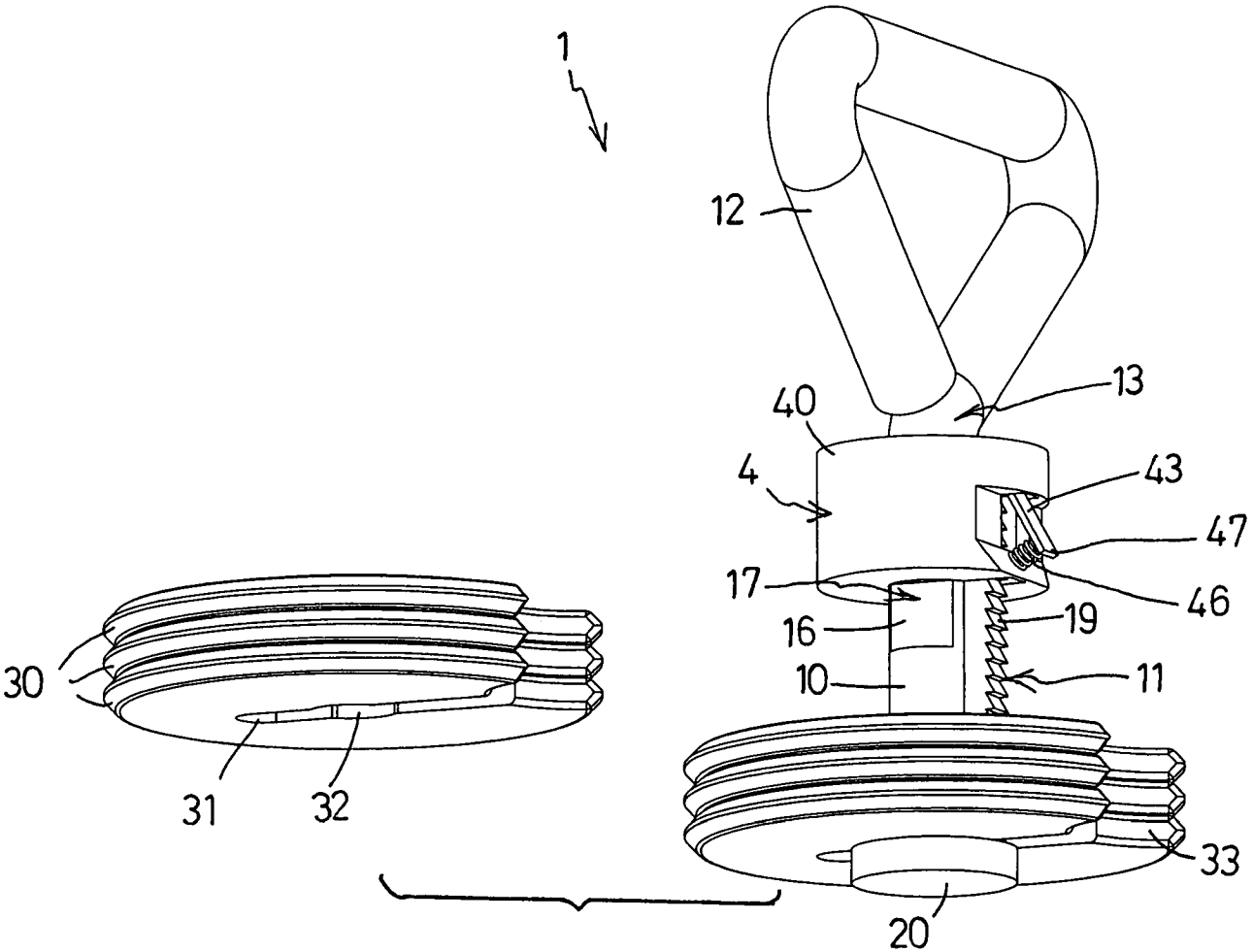
FIG. 5 is another partial exploded view illustrating the operation of the adjustable kettlebell.

A number of weight plates or weight members 30 each include a substantially U-shaped structure having a slot 31 formed therein for receiving the narrowed neck segment 17 of the central shaft 10, and for allowing the weight members 30 to be easily and quickly attached to or disengaged from the central shaft 10 without disengaging or disassembling the base plate 20 from the shaft 10, in which the slots 31 of the weight members 30 include a width equals to or slightly greater than or no less than the narrowed portion the narrowed neck segment 17 of the shaft 10, but smaller than the outer diameter of the other portion of the shaft 10, for allowing only the narrowed portion the narrowed neck segment 17 of the shaft 10 to be engaged into the slots 31 of the weight members 30 (FIGS. 3, 5).

The weight members 30 each further include an enlarged opening 32 formed therein, such as formed in the middle or central portion thereof and communicating with the slot 31 of the weight member 30, and having a width or inner diameter greater than the width of the slots 31 of the weight members 30 and equals to or slightly greater than or no less than the outer diameter of the shaft 10 for receiving the shaft 10, and for allowing the weight members 30 to be stably retained or anchored to the shaft 10 and for preventing the weight members 30 from being disengaged from the shaft 10 when the weight members 30 are offset from the narrowed neck segment 17 of the shaft 10.

It is preferable that the weight members 30 each include a wide open end 33 formed at one end of the slot 31 of the weight member 30 or communicating with the slot 31 of the weight member 30 for allowing the narrowed neck segment 17 of the shaft 10 to be guided to easily and quickly engage into the slots 31 of the weight members 30. A fastening or locking device 4 includes a ring or sliding member 40 slidably attached onto the shaft 10, or the sliding member 40 includes a bore 41 formed therein (FIGS. 1-3) for slidably receiving the shaft 10, and for allowing the sliding member 40 to be moved along or relative to the shaft 10, and the sliding member 40 may be moved to engage with the weight members 30 after the weight members 30 have been engaged onto the shaft 10 and after the weight members 30 have been disengaged or offset from the narrowed neck segment 17 of the shaft 10 (FIG. 2), in order to stably anchor or position or retain or secure the weight members 30 to the shaft 10.

Figure 4:
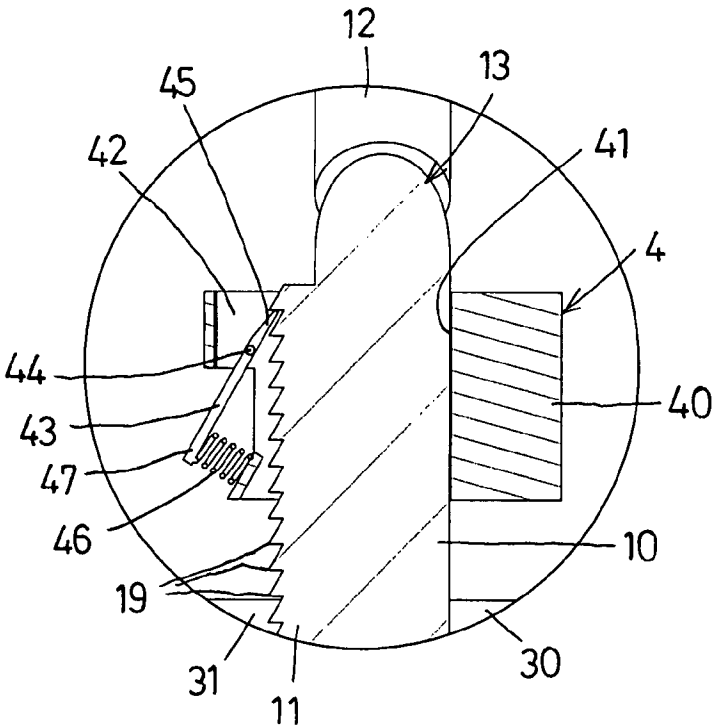
FIG. 4 is an enlarged partial cross sectional view of the adjustable kettlebell.

The sliding members 40 each further include a channel 42 formed therein and communicating with the bore 41 of the sliding member 40 for slidably receiving the rack 11 of the shaft 10, and/or for preventing the sliding members 40 from being rotated relative to the shaft 10. The sliding member 40 of the locking device 4 further includes a latch 43 partially engaged into the channel 42 of the sliding member 40 and rotatably or pivotally attached or mounted or secured onto the sliding member 40 with a pivot axle 44 for allowing one end or free end or actuating end 45 of the latch 43 to be engaged with the teeth 19 of the rack 11 in order to adjustably secure or lock or latch the sliding member 40 and the weight members 30 to the shaft 10. A spring member 46 is disposed between the other end 47 of the latch 43 and the sliding member 40 for biasing or forcing the actuating end 45 of the latch 43 to engage with the teeth 19 of the rack 11 (FIGS. 3, 4).

In operation, as shown in FIGS. 1, 5, the selected or the required number of the weight members 30 may be easily and quickly engaged onto the shaft 10 by engaging the narrowed neck segment 17 of the shaft 10 into the slots 31 of the weight members 30, and the weight members 30 may then be disengaged or offset from the narrowed neck segment 17 of the shaft 10 and may have the shaft 10 stably anchored or positioned or retained or secured in the enlarged openings 32 of the weight members 30 relatively when the weight members 30 are disengaged or offset from the narrowed neck segment 17 of the shaft 10. The sliding member 40 of the locking device 4 may then be moved along or relative to the shaft 10 and may be engaged with the weight members 30 for stably locking or securing the weight members 30 to the shaft 10. The sliding member 40 may be freely moved along or relative to the shaft 10 when the other end 47 of the latch 43 is depressed by the user to compress the spring member 46 and to disengage the actuating end 45 of the latch 43 from the teeth 19 of the rack 11.

It is to be noted that the selected or the required number of the weight members 30 may be easily and quickly engaged onto the shaft 10 and may be easily and quickly locked or secured to the shaft 10 with the sliding member 40 of the locking device 4 such that the weight members 30 may be changeably and easily and quickly mounted or attached to the shaft 10. On the contrary, when the sliding member 40 of the locking device 4 is disengaged or offset from the narrowed neck segment 17 of the shaft 10, the weight members 30 may be easily and quickly engaged onto or disengaged from the shaft 10.

Accordingly, the adjustable kettlebell in accordance with the present invention includes an improved structure for allowing the weight members to be easily and adjustably attached to or disengaged from the weight carrier and for allowing the adjustable kettlebell to be easily operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable kettlebell comprising:

a shaft including a first end portion, and including a second end portion, and including a narrowed neck segment formed in said first end portion of said shaft, a base plate attached to said second end portion of said shaft and including an outer diameter greater than that of said shaft, a first weight member and at least one second weight member each including a slot formed therein and having a width no less than said narrowed neck segment of said shaft for receiving said narrowed neck segment of said shaft, and for allowing said first and said at least one second weight members to be attached to and disengaged from said shaft, said first and said at least one second weight members each including an enlarged opening formed therein and communicating with said slot of said first and said at least one second weight member, and said enlarged opening including an inner diameter greater than the width of said slots of said first and said at least one second weight members and no less than the outer diameter of said shaft for receiving said shaft, and for allowing said first and said at least one second weight members to be retained to said shaft and for preventing said first and said at least one second weight members from being disengaged from said shaft when said first and said at least one second weight members are offset from said narrowed neck segment of said shaft, and a sliding member slidably attached onto said shaft for engaging with said at least two weight members after said at least two weight members have been engaged onto said shaft and after said at least two weight members have been disengaged from said narrowed neck segment of said shaft, and said sliding member including a latch for engaging with said shaft and for selectively locking said sliding member to said shaft, in order to retain and secure said at least two weight members to said shaft.

2. The adjustable dumbbell as claimed in claim 1, wherein said shaft includes a rack provided on said shaft for selectively engaging with said latch.

3. The adjustable dumbbell as claimed in claim 2, wherein said sliding member includes a channel formed therein for slidably receiving said rack of said shaft.

4. The adjustable dumbbell as claimed in claim 2, wherein said latch is pivotally attached to said sliding member with a pivot axle and includes an actuating end for engaging with said rack and for adjustably latching said sliding member and said weight members to said shaft.

5. The adjustable dumbbell as claimed in claim 4, wherein said sliding member includes a spring member disposed between said latch and said sliding member for biasing and forcing said actuating end of said latch to engage with said rack.

6. The adjustable dumbbell as claimed in claim 1, wherein said shaft includes at least one notch formed in said shaft for forming said narrowed neck segment in said shaft.

7. The adjustable dumbbell as claimed in claim 1, wherein said at least two weight members each include an open end communicating with said slots of said at least two weight members for guiding said narrowed neck segment of said shaft into said slots of said at least two weight members.

8. The adjustable dumbbell as claimed in claim 1, wherein said shaft includes a hand grip provided on said first end portion of said shaft.

* * * * *